US009827475B2

(12) United States Patent
Holland et al.

(10) Patent No.: US 9,827,475 B2
(45) Date of Patent: Nov. 28, 2017

(54) BASEBALL BATTING TEE

(71) Applicant: Pro Performance Sports, L.L.C., Carlsbad, CA (US)

(72) Inventors: Allen Keith Holland, Carlsbad, CA (US); Kash Oris Bell, Carlsbad, CA (US)

(73) Assignee: PRO PERFORMANCE SPORTS, LLC, Carlsbad, CA (US)

( * ) Notice: Subject to any disclaimer, the term of this patent is extended or adjusted under 35 U.S.C. 154(b) by 0 days.

(21) Appl. No.: 14/687,006

(22) Filed: Apr. 15, 2015

(65) Prior Publication Data

US 2016/0303450 A1 Oct. 20, 2016

(51) Int. Cl.
*A63B 71/00* (2006.01)
*A63B 69/00* (2006.01)

(52) U.S. Cl.
CPC ..... *A63B 69/0002* (2013.01); *A63B 69/0075* (2013.01); *A63B 2069/0008* (2013.01); *A63B 2208/0204* (2013.01); *A63B 2210/50* (2013.01); *A63B 2225/093* (2013.01)

(58) Field of Classification Search
CPC ..... A63B 69/0002; A63B 69/0053; A63B 69/0091; A63B 69/0075; A63B 69/0079; A63B 69/00
USPC ..... 473/422, 417, 451
See application file for complete search history.

(56) References Cited

U.S. PATENT DOCUMENTS 2,976,041 A * 3/1961 White ..... A63B 69/0075 473/417
3,039,770 A * 6/1962 Ferretti ..... A63B 69/0075 473/454
3,883,138 A * 5/1975 Chorey ..... A63B 69/0075 473/417
4,227,691 A 10/1980 Lefebvre et al.
5,386,987 A * 2/1995 Rodino, Jr. ..... A63B 69/0075 473/417
5,916,045 A * 6/1999 Busch ..... A63B 69/0075 473/417
5,967,910 A * 10/1999 Lin ..... A63B 69/0075 473/417
6,884,185 B2 * 4/2005 Udwin ..... A63B 69/0075 473/422
6,893,363 B1 * 5/2005 Chen ..... A63B 69/0002 473/417
7,744,496 B2 6/2010 Chisena
8,109,844 B1 * 2/2012 Quinn ..... A63B 69/0075 473/417
8,246,492 B2 * 8/2012 Gangelhoff ..... A63B 69/00 473/417

(Continued)

OTHER PUBLICATIONS

International Search Report and Written Opinion issued in PCT/US2016/027279 on Sep. 16, 2016 (10 pages).

*Primary Examiner* — Mitra Aryanpour
(74) *Attorney, Agent, or Firm* — NorthStar Law Group

(57) ABSTRACT

A batting tee has a post including a ball holder on a top end of a post, and a tube cap on a bottom end of the post. A receptacle is positioned in a recess in a base frame having a through hole. The tee is set up for use by passing the post through the through hole from the bottom of the base and securing the tube cap to the base. The batting tee may be set up for use, and disassembled for transport or storage, quickly and easily.

20 Claims, 4 Drawing Sheets

(56) References Cited

U.S. PATENT DOCUMENTS

| | | | | |
|---|---|---|---|---|
| 8,393,980 | B2 * | 3/2013 | Chen | A63B 69/0002 473/417 |
| 8,485,922 | B2 * | 7/2013 | Liao | A63B 69/0002 473/417 |
| 8,597,143 | B2 * | 12/2013 | Newman | A63B 69/0075 473/417 |
| 8,821,322 | B1 * | 9/2014 | Jorgens | A63B 69/0075 473/417 |
| 9,050,516 | B2 * | 6/2015 | Holland | A63B 69/0075 473/417 |
| 2003/0036446 | A1 | 2/2003 | Udwin et al. | |
| 2009/0270205 | A1 * | 10/2009 | Liao | A63B 69/0002 473/417 |
| 2014/0302948 | A1 | 10/2014 | Holland et al. | |

* cited by examiner

BASEBALL BATTING TEE

BACKGROUND OF THE INVENTION

A batting tee is used by to practice hitting a baseball or softball held at various positions within or near the strike zone. By using a batting tee to practice hitting a stationary ball, players can improve their batting swings and learn to hit balls from various locations. Since the tee is often struck by the bat, it must be impact resistant. At the same time, the tee should also hold the ball in a way that minimally interferes with the bat, so that hitting the ball off of the tee better simulates hitting a pitched ball. The batting tee may also tip over when hit with a bat. This interrupts the batting practice since the user must then pick up and reset the batting tee. Consequently, a tee designed to resist tipping is beneficial. The batting tee should also be easily portable and quick to set up and take down.

Various batting tees have been proposed in the past. Generally these batting tees have a flat base or plate, an adjustable length post on the plate, and a ball holder at the top end of the post. Examples are shown in Lefebvre U.S. Pat. No. 4,227,691; Rodino U.S. Pat. No. 5,386,987; Tanner U.S. Pat. No. 6,358,163 and Quinn U.S. Patent Publication No. 2014/0302948. While these and other designs may have met with varying degrees of success, engineering challenges remain to providing an improved batting tee.

SUMMARY OF THE INVENTION

A batting tee has a post including a ball holder on a top end of a post, and a tube cap on a bottom end of the post. A receptacle is positioned in a recess in a base frame having a through hole. The tee is set up for use by passing the post through the through hole from the bottom of the base and securing the tube cap to the base. The batting tee may be set up for use, and disassembled for transport or storage, quickly and easily.

DETAILED DESCRIPTION OF THE DRAWINGS

Figure 1:
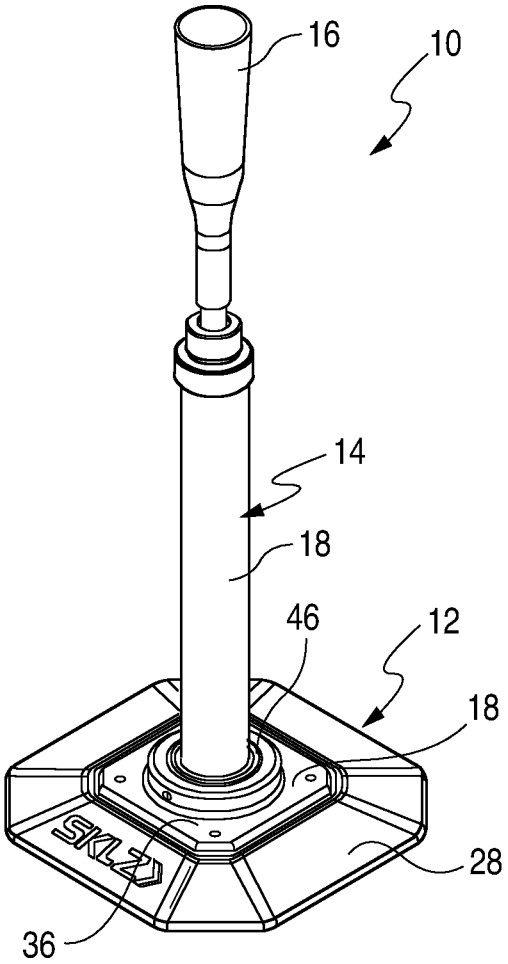
FIG. 1 is a top perspective view of a batting tee with a telescoping post in an retracted position.
Figure 2:
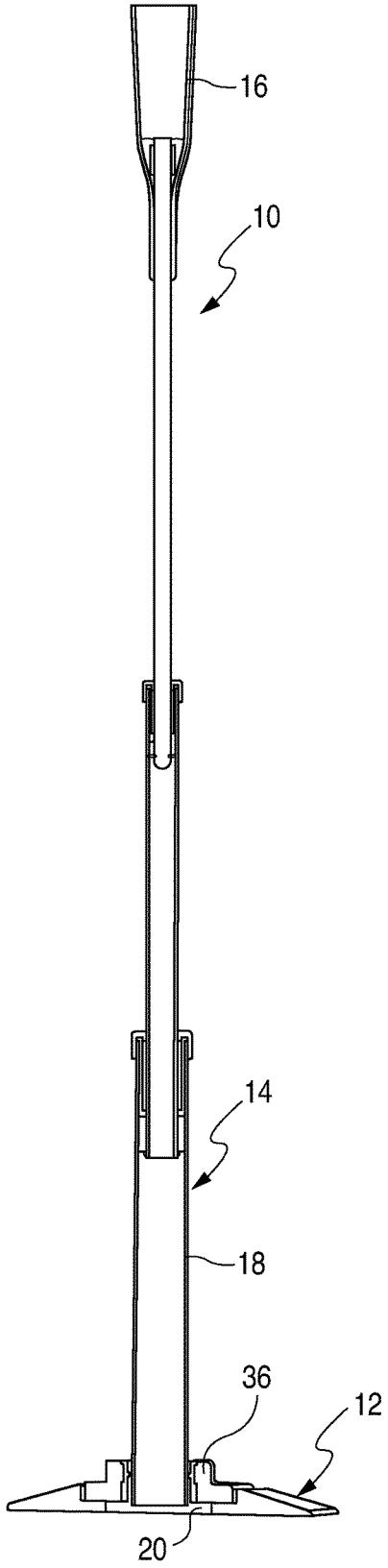
FIG. 2 is a section view of the tee of FIG. 1 now in a fully extended position.

As shown in FIGS. 1 and 2, a batting tee 10 has a telescopically extendable post 14 which is attached to a base 12. The a ball holder 16 is provided at the top end of the post. The ball holder 16 may be a cone of rolled up rubber and/or fabric, as described in Newman U.S. Pat. No. 8,597,143, incorporated herein by reference. The post 14 in the example shown has a fixed lower tube 18 and two telescoping tubes. An end cap 20 at the bottom end of the lower tube 18 has and end tube 52 joined to a disk 54. The bottom end of the lower tube is connected to an end tube 52 on the end cap 20. The lower tube 18 and the tube end cap 20 may be made of a heavy material such as steel, to provide additional weight at the bottom of the post 14 for improved stability.

Figure 3:
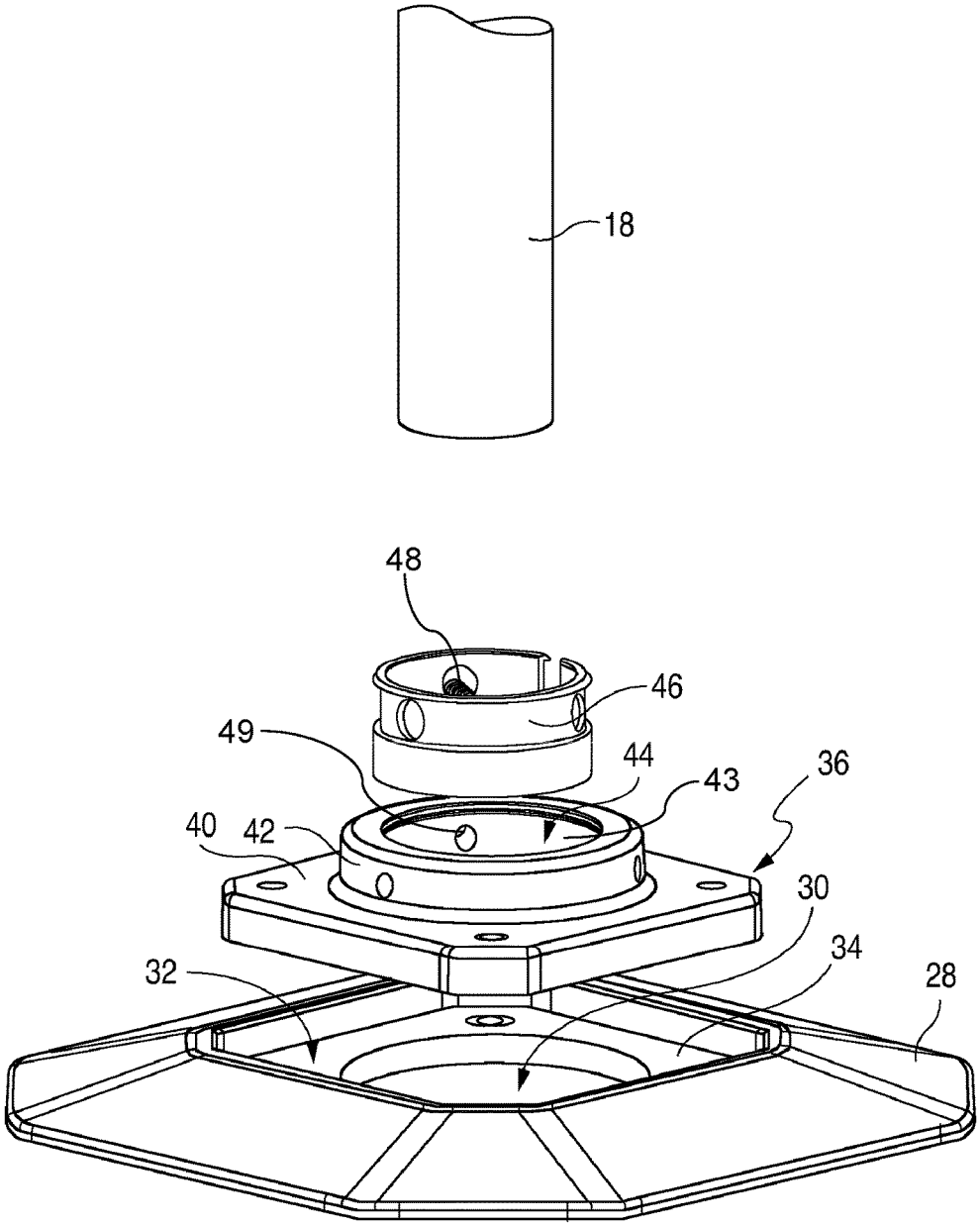
FIG. 3 is top exploded perspective view of the base of the tee shown in FIGS. 1 and 2.
Figure 4:
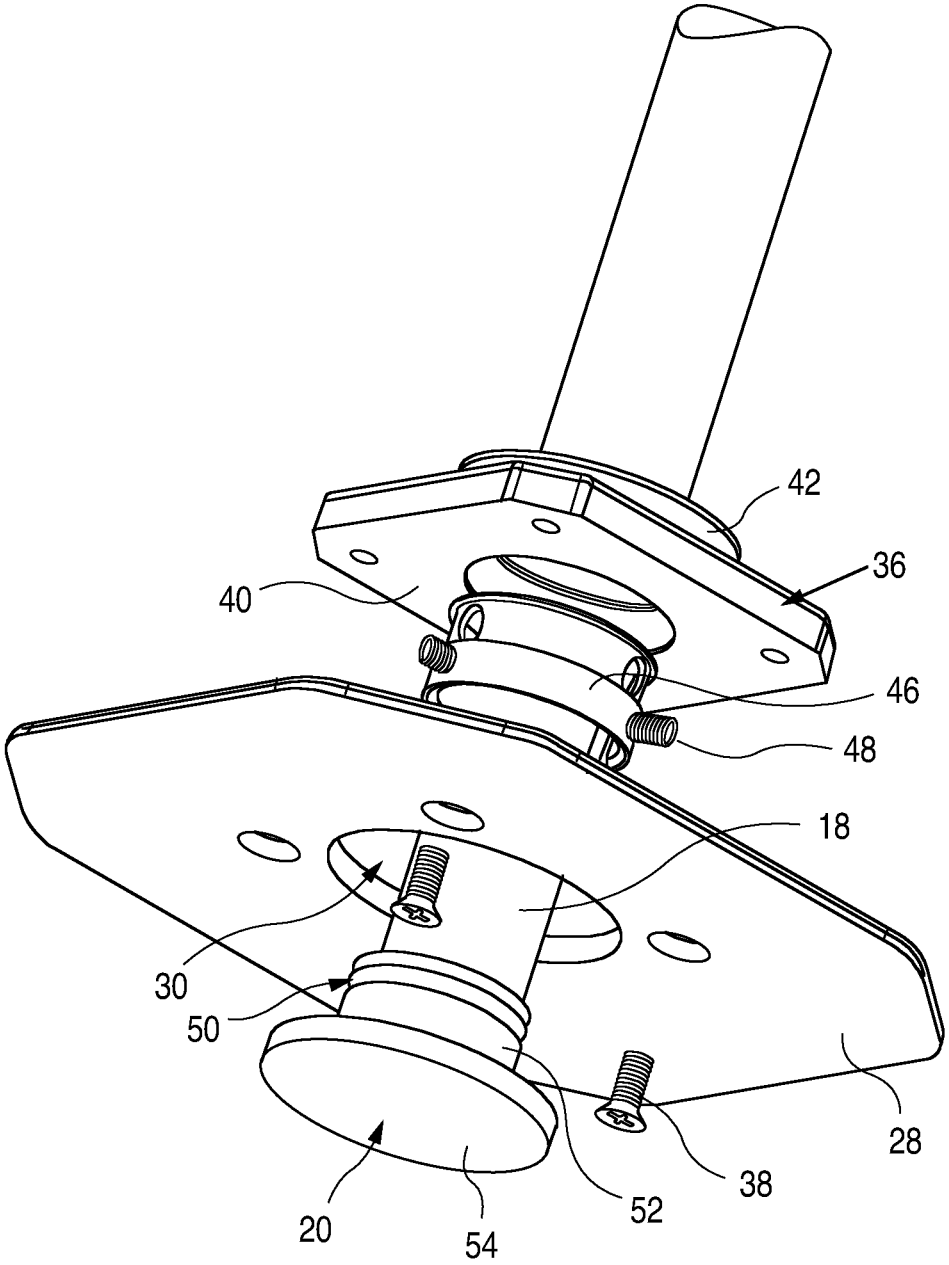
FIG. 4 is a bottom exploded perspective view of the base of the tee shown in FIGS. 1 and 2.

As shown in FIGS. 3 and 4, the base 12 may be generally square, with curved or angled corners and angled side surfaces, similar to a low profile four sided pyramid. In the example shown, the base has a receptacle 36 fitted into a recess 32 in the top surface of base frame 28, which may be metal, rubber or plastic. The receptacle 36 has receptacle collar 42 joined to or integral with a receptacle plate 40. The receptacle plate 40 is secured onto or into the base frame 28 via receptacle screws 38, with a flat bottom surface of the receptacle plate 40 on a floor 34 of the base frame 28. The receptacle 36 may also be made of a heavy material, such as steel, to add further weight at the bottom of the post. The receptacle 36 and the base frame 28 may optionally be provided as a single unit rather than as two separate components.

A frame opening 30 may be centrally located in the base frame 28 and surrounded by the base floor 34. The frame opening 30 has a diameter nominally larger than the diameter of the lower tube 18. The receptacle 36 has a collar opening 44 aligned with the frame opening 30, and having a diameter smaller than the frame opening 30. A detent ring 46 may be positioned within the collar opening 44, with set screws securing detent fittings 48 in cavities 49 on an interior surface 43 of the receptacle collar 42 (such as detent balls or pins) in place. The disk 54 has a diameter nominally smaller than the diameter of the frame opening 30.

In use, the tee 10 is assembled by inserting the post 14 through the base opening 30 up from the bottom of the base 12. The maximum diameter of the ball holder 16 is nominally smaller than the diameter of the collar opening 44 to allow it to pass through the collar opening 44. Alternatively, the ball holder 16 may be temporarily compressed inwardly by hand and threaded through the collar opening 44. The top surface of the disk 54 of the end cap 20 comes to rest against a bottom surface of the receptacle plate 40, with the bottom surface of the disk 54 flush with the bottom surface of the base frame 28. The detent devices on the receptacle collar 42 engage into a groove 50 on the end cap 20, securing the post 14 to the base 12.

The tee is then ready for use. If the post 14 is a telescoping post having two or more telescoping tubes, the height of the post may be adjusted as desired. The weight of the base 12 and the lower tube 18 help to prevent the tee 10 from tipping over when hit by a bat. The tee 10 is disassembled by pushing the post 14 back through the base 12, allowing the tee 10 to be stored and transported in a compact configuration.

Thus, novel batting tees have been shown and described. Various changes and substitutions may of course be made without departing from the spirit and scope of the invention. The invention, therefore, should not be limited except by the following claims and their equivalents.

The invention claimed is:

1. A batting tee, comprising:

a post including a ball holder on a top end of the post, and an end cap on a bottom end of the post;

a base having a receptacle attaching to a base frame, with the receptacle having a receptacle plate sized and shaped to fit within a recess in a top portion of the base frame and a receptacle collar extending from a top surface of the receptacle plate, the receptacle collar having a collar opening extending through the receptacle and aligned with a frame opening in the base frame, the frame opening sized and shaped such that a disk on a bottom of the end cap fits within the frame opening, the collar opening sized and shaped such that the collar opening is smaller than both the frame opening in the base frame and the disk of the end cap such that the disk cannot pass through the collar opening and the disk is retained within the frame opening by the receptacle plate;

one or more detent fittings including one or more of detent balls and pins, with each of the detent fittings disposed within a cavity on an interior surface of the receptacle collar; and a groove on the end cap to cooperate with the detent fittings for securing the post onto the base with the post extending through the collar opening.

2. The batting tee of claim 1 with the end cap including a tube joined to the disk, and with a lower end of the post joined to the tube.

3. The batting tee of claim 1 with the receptacle plate matching a shape of the recess.

4. The batting tee of claim 1 with the ball holder having a diameter less than a diameter of the receptacle opening to allow the post to be passed through the base.

5. The batting tee of claim 1 with the receptacle plate and the base frame provided as a single unit.

6. The batting tee of claim 1 with the post including a first tube, a second tube, and a third tube, with the end cap attached to the first tube at the bottom end of the post, with the second tube and third tube telescopically extendable from the first tube, and with the ball holder at a top end of the third tube.

7. The batting tee of claim 1 with a bottom surface of the disk flush with a bottom surface of the base frame.

8. The batting tee of claim 1 further comprising a detent ring positioned within the collar opening and disposed in-between the post and the collar, the detent ring including openings for projection of the one or more detent fittings therethrough.

9. The batting tee of claim 1 wherein the post is engaged to the base by inserting the top end of the post first through the frame opening and then through the collar opening.

10. The batting tee of claim 1 wherein the receptacle plate is releasably attached to the base frame.

11. The batting tee of claim 1 wherein the ball holder is temporarily compressible such that the ball holder can pass through the collar opening.

12. The batting tee of claim 1 wherein the receptacle is made of metal providing weight toward the bottom end of the post for improved stability during use.

13. The batting tee of claim 1 wherein at least a portion of the post including the end cap and the bottom end of the post is made of steel to provide additional weight at the bottom end of the post for improved stability during use.

14. The batting tee of claim 1 wherein the post is releasable from the base by pushing the post through a bottom end of the base to disengage the one or more detent fittings from the groove of the end cap.

15. A batting tee, comprising:

a ball holder on a top end of a post;

a tube cap on a bottom end of the post, with the tube cap having a disk joined to an end tube, and with the post joined to the end tube;

a base having a through hole sized and shaped such that the disk of the tube cap fits within the through hole, and a recess in a top surface of the base;

a receptacle in the recess having a collar joined to a plate, with a collar opening extending through the collar and the plate, the collar opening aligned with and smaller than the through hole such that the disk cannot fit within the collar opening but the end tube of the tube cap fits within the collar opening; and one or more detent fittings including one or more of detent balls and pins, with each of the detent fittings disposed within a cavity on an interior surface of the collar and engaging a groove on the end tube to retain the end tube within the collar thereby securing the post to the base.

16. The batting tee of claim 15 wherein the ball holder is sized and shaped such that the ball holder can pass through the opening in the collar, and wherein the post is secured to the base by inserting the top end of the post first through the through hole and then through the opening in the collar.

17. The batting tee of claim 15 wherein a top surface of the disk of the tube cap comes to rest against a bottom surface of the plate.

18. The batting tee of claim 17 wherein a bottom surface of the disk is flush with a bottom surface of the base.

19. The batting tee of claim 15 wherein the post is releasable from the base by pushing the post through a bottom end of the base to disengage the one or more detent fittings from the groove of the end tube.

20. A batting tee, comprising:

a base comprising:

a base frame having a frame opening disposed therethrough and a recess formed in a top portion of the base frame;

a receptacle plate sized and shaped to fit within the recess of the base frame, the receptacle plate including a receptacle opening aligned with the frame opening when the receptacle plate is disposed within the recess of the base frame, the receptacle opening smaller than the frame opening; and a detent fitting including one or more of a detent ball and a pin, the detent fitting disposed on an interior surface of the receptacle opening; and a post structurally configured for releasably securing to the base, the post comprising:

a ball holder disposed on a top end of the post;

a lower tube disposed beneath the ball holder, the lower tube including an end cap on a terminal end thereof, the end cap including a disk that is larger than the receptacle opening and smaller than the frame opening such that the disk fits within the frame opening beneath the receptacle plate when the receptacle plate is disposed within the recess of the base frame and the post is secured to the base; and a groove disposed on one or more of the lower tube and the end cap, the groove sized and shaped to cooperate with the detent fitting for releasably securing the post onto the base with the top end of the post inserted through the frame opening and the receptacle opening, the post releasable from the base by pushing the post through a bottom end of the base to disengage the detent fitting from the groove.

* * * * *